United States Patent [19]

Tanaka et al.

[11] 3,972,611

[45] Aug. 3, 1976

[54] APPARATUS FOR TRANSFERRING IMAGES PRODUCED BY LIQUID DEVELOPER

[75] Inventors: Hiroshi Tanaka; Takashi Saito, both of Tokyo, Japan

[73] Assignee: Canon Kabushiki Kaisha, Tokyo, Japan

[22] Filed: July 15, 1974

[21] Appl. No.: 488,453

Related U.S. Application Data

[60] Division of Ser. No. 366,262, June 4, 1973, which is a continuation of Ser. No. 122,861, March 10, 1971, abandoned.

[30] Foreign Application Priority Data

Mar. 18, 1970 Japan ..... 45-22822

[52] U.S. Cl. ..... 355/10; 118/DIG. 23; 355/15; 427/15

[51] Int. Cl.² ..... G03G 15/10

[58] Field of Search ..... 355/10, 15; 96/1 LY, 96/1.4; 117/37 LE; 317/2 R; 427/16, 17, 15; 118/DIG. 23

[56] References Cited

UNITED STATES PATENTS

| | | | |
|---|---|---|---|
| 3,084,061 | 4/1963 | Hall | 96/1 R X |
| 3,155,546 | 11/1964 | Dirks | 118/DIG. 23 |
| 3,186,838 | 6/1965 | Graff et al. | 96/1.4 |
| 3,300,410 | 1/1967 | Oliphant | 252/62.1 |
| 3,337,340 | 8/1967 | Matkan | 252/62.1 X |
| 3,355,288 | 11/1967 | Matkan | 96/1 LY |
| 3,368,894 | 2/1968 | Matkan et al. | 117/37 LE X |
| 3,392,707 | 7/1968 | Marx | 117/37 LE |
| 3,438,706 | 4/1969 | Tanaka et al. | 355/11 |
| 3,444,369 | 5/1969 | Malinaric | 96/1.4 |
| 3,556,784 | 1/1971 | Robinson et al. | 96/1.4 |
| 3,576,623 | 4/1971 | Snelling | 355/10 X |
| 3,650,622 | 3/1972 | Morse | 355/10 |
| 3,663,219 | 5/1972 | Takahashi | 355/10 |
| 3,712,728 | 1/1973 | Whittaker | 96/1 LY X |
| 3,722,994 | 3/1973 | Tanaka et al. | 355/10 |
| 3,748,126 | 7/1973 | Ferguson et al. | 355/10 X |
| 3,764,207 | 10/1973 | Obuchi | 117/37 LE X |
| 3,782,818 | 1/1974 | Smith | 117/37 LE X |
| 3,784,397 | 1/1974 | Sato et al. | 96/1 LY X |

OTHER PUBLICATIONS

Crawford, T. M., "Developing Electrophotographic Images", IBM Technical Disclosure Bulletin, vol. 8, No. 4, Sept. 1965, p. 488.

*Primary Examiner*—Fred L. Braun

*Attorney, Agent, or Firm*—Fitzpatrick, Cella, Harper & Scinto

[57] ABSTRACT

An apparatus for transferring images produced by liquid developer in a photographic process which comprises a device for applying a corona charging to a photosensitive member after the development of latent images to increase the attaching force of a toner of the developed image to the photosensitive member and remove the liquid developer, and for transferring the developed image to a copying web. The corona charging may be applied to the photosensitive member at a point, after development, and an angle subtended by a vertical line passing the center of a drum photosensitive member and a line connecting the center of the drum photosensitive member with the point on the surface of the drum photosensitive member to which the corona charging is applied is not larger than 60°.

12 Claims, 2 Drawing Figures

APPARATUS FOR TRANSFERRING IMAGES PRODUCED BY LIQUID DEVELOPER

This is a division of application Ser. No. 366,262, filed June 4, 1973, which in turn is a continuation of Ser. No. 122,861, filed Mar. 10, 1971 and now abandoned.

BACKGROUND OF THE INVENTION

1. Field of the Invention

This invention relates to apparatus for transferring images produced by liquid developer in electrophotographic processes.

2. Description of the Prior Art

Heretofore, a liquid development of latent images in electrophotography is usually carried out on a selenium photosensitive member in Xerography or a photosensitive member (e.g. U.S. Ser. No. 563,899, filed July 8, 1966 and U.S. Ser. No. 571,538, filed Aug. 10, 1966) having an insulating layer on a photoconductive layer and the surface being smooth. The image thus developed often flows due to the smooth surface of the photosensitive member, and the presence of carrier liquid. In other words, the toner in the developed image flows since the Coulomb's force of the charge of the latent image for retaining the toner is overcome by the flowing action of the carrier liquid caused by movement of the photosensitive member, for example, rotation of a drum photosensitive member. As a result, disorder of toner image occurs, that is, even a slight external force disturbs the developed toner image.

For the purpose of improving the transferring efficiency and obtaining high speed development, it is preferable to use a liquid developer having relatively low electric resistance such as $1 \times 10^{10} - 5 \times 10^{12}\Omega$. cm. However, in such a case the neutralization of charge of the latent image rapidly proceeds and therefore, Coulomb's force is decreased rapidly and thereby the image flow becomes remarkable.

SUMMARY OF THE INVENTION

This invention relates to apparatus for transferring images produced by liquid developer in a photographic process which comprises a device for applying a corona charging to a photosensitive member after the development of latent images to increase the attaching force of a toner of the developed image to the photosensitive member, and to remove the liquid developer and transferring the developed image to a copying web. And it is preferable to apply the corona charging to the photosensitive member, after development, at such a point that an angle subtended by a vertical line passing the center of a drum photosensitive member and a line connecting the center of the drum photosensitive member with the point on the surface of the drum photosensitive member to which the corona charging is applied is not larger than 60°.

Further, it is also preferable to use a liquid developer having electric resistance of $1 \times 10^{10} - 5 \times 10^{12}\Omega$. cm.

An object of this invention is to provide apparatus for transferring images produced by a liquid developer without any disorder.

Another object of this invention is to provide apparatus for giving an image produced by a toner adhered tightly to a copying paper.

A further object of this invention is to provide an image of good quality by using a liquid developer of low electric resistance.

Still another object of this invention is to provide apparatus for transferring images produced by a liquid developer at high speed and with high transferring efficiency.

Still further object of this invention is to provide apparatus for producing clear transferred images.

DESCRIPTION OF THE PREFERRED EMBODIMENT

The present invention will be described in connection with electrophotographic processes as disclosed in U.S. Ser. No. 563,899, filed July 8, 1966 and U.S. Ser. No. 571,538, filed Aug. 10, 1966.

Figure 1:
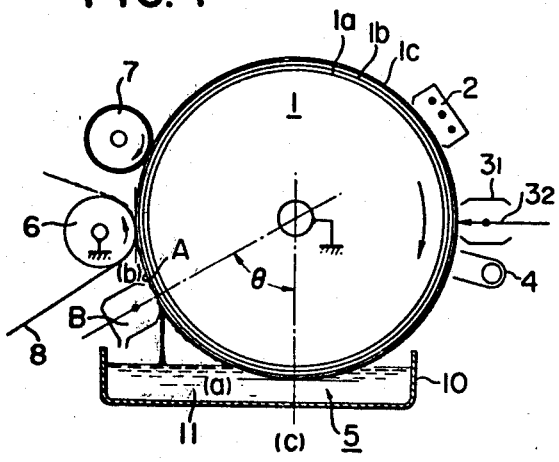
FIG. 1 schematically shows a cross sectional view of an apparatus carrying out an embodiment of this invention.

Referring to FIG. 1, a photosensitive member 1 comprises a base 1*a*, a photoconductive layer 1*b* and an insulating layer 1*c* and is uniformly charged by a primary charging device 2, then charged with DC voltage having a polarity opposite to the primary charging or AC corona discharge by using a charging device $3_1$ simultaneously with exposing to a light image as represented by $3_2$, and further the whole surface of photosensitive member 1 is exposed to a light denoted as 4 to form an electrostatic latent image. The latent image thus produced is developed by a developing device 5 (5' in FIG. 2) and transferred to a copying paper 8 by a transferring roller 6 and, then photosensitive member 1 is cleaned by a cleaning roller 7.

Figure 2:
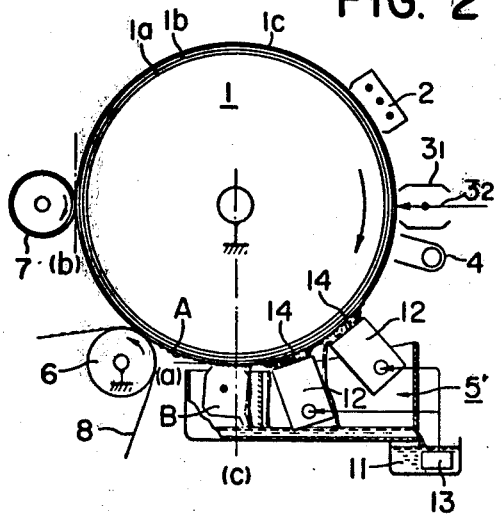
FIG. 2 schematically shows a cross sectional view of an apparatus carrying out another embodiment of this invention.

FIG. 1 and FIG. 2 are different from each other only in the point of developing device. In FIG. 1 the development is carried out by a soaking developing method comprising soaking the lower portion of drum 1 in a liquid developer 11 placed in a developing vessel, while in FIG. 2 the developing is conducted by a contacting developing method comprising slowly flowing out a liquid developer from a flowing mouth at the top of a liquid developer feeding box 12 and contacting the liquid developer with the drum surface. The liquid developer 11 is charged to the liquid developer feeding box 12 by a pump 13. According to the another embodiment of the contacting method, a roller is placed in a liquid developer in such a way that the lower half of the roller is soaked in the liquid developer or two rollers are arranged in such a way that each of these rollers rotates to a inside direction, and thereby the liquid developer rises to contact a lower surface of the drum photosensitive member 1 to develop the latent image.

Another example of liquid developing means for such a drum photosensitive member is a cascade developing method comprising pouring a liquid developer onto a rotating drum photosensitive member from the upper portion or from the side portion and flowing down the liquid developer along the surface of the drum photosensitive member.

In all of the above-mentioned liquid developing methods using a photosensitive drum member, the surface of a member 1 being developed moves upwardly according to the rotation of the photosensitive drum member. For example, in FIG. 1 and FIG. 2, a tangent line at an image A changes from the horizontal direction (*a*) via a slanting direction to the vertical direction (*b*) and during such step of changing the tangent line from the horizontal to the vertical direction, an image flow at the surface of the drum photosensitive is liable to occur. The image flow is caused by a flow on the surface of the drum photosensitive member to a direction opposite to the rotation of the drum which removes the toners attached to the latent image from the surface of the drum and further the smoothness of the photosensitive member accelerates such tendency.

The present inventors have found that when the charging device is fitted to a position within an angle of 60°, as mentioned above, image flow is not adverse.

In FIG. 1, the charging device B is located at the position of about 60° while in FIG. 2 the charging device is located at the position almost beneath the center of the drum.

According to such arrangement of the charging device, the developed image can be tightly attached to the surface of the photosensitive member before the carrier liquid attached to the surface of the drum photosensitive member immediately after the development does not begin to flow or during a period that the flowing of the carrier liquid is still slow and does not adversely affect the developed image. Furthermore, most of the carrier liquid can be removed from the drum photosensitive member and an image surface having little carrier liquid attached thereto moves upwardly. Therefore, when the image is transferred to a copying paper, a transferred image free from disorder can be obtained. If the charging device B is located at a portion larger than 60°, the carrier liquid naturally flowing down along the surface of the drum photosensitive member combined with a carrier liquid squeezed out by the charging causes an image flow to a great extent.

It is preferable to arrange the charging device B as illustrated in FIG. 2, at a portion near to a point beneath the center of the drum as far as possible, but an opening may be provided to the charging device B as shown in FIG. 1 and FIG. 2 so as to remove the liquid developer coming thereinto.

According to this invention, there is used a liquid developer of relatively low electric resistance such as $1 \times 10^{10} - 5 \times 10^{12}\Omega$. cm. The liquid developer of low resistance improves the mobility of toner and is suitable for a high speed development and further the transferring efficiency is increased as a result of reduction of adhering force to the photosensitive member since the charge is rapidly neutralized with the charge of latent image after the development. However, the rapid neutralization disadvantageously causes the image flow as mentioned above before the transferring of developed images.

It is most preferable that the developed image is electrically attached tightly to the surface of the photosensitive member and the electrical adhering force is disappeared at a time of transferring because such a condition enables to increase a developing speed and produce an image free from disorder at a high efficiency.

According to the present invention the above-mentioned purpose can be attained by using a liquid developer of low electric resistance in combination with the charging device placed at a specified point. That is, a corona charging is directly applied to a surface of the photosensitive member developed by the liquid developer of low resistance at high speed and the image thus developed is tightly attached to the photosensitive member by a charge of polarity similar to that of the toner at the non-image portion and the carrier liquid is removed.

At the time of transferring, the charge of the latent image relating to the image toner is neutralized with an ion component in the carrier and/or charging of development to reduce the electric force and thereby the developed image can be transferred to a copying paper at high efficiency without causing disorder.

In FIG. 2, there is used a liquid developer of volume resistivity of $1 \times 10^{10} - 5 \times 10^{12}\Omega$. cm. comprising a coloring matter mainly composed of carbon black and a resin dispersed in Isopar G (tradename, supplied by ESSO) to which is added asphalt, motor oil and a fatty acid. As the result, the developing velocity is increased and thereby to give a good image at high transferring efficiency.

Particularly, this invention is very effective for a liquid developing of an electrostatic latent image on a photosensitive member having a highly insulating film. When a film material of extremely low $RC = \tau$ (time constant) such as Mylar (tradename, supplied by E. I. Du Pont de Nemours & Co., Inc.) is used, the charge is apt to disappear when it contacts the surface of the liquid developer. In this invention, it is preferable to place the charging device at a position at which the developed image arrives within about 5 seconds.

We claim:

1. An electrophotographic copying device comprising an image-bearing member on which latent electrostatic images are formed, developed with toner and thereafter transferred to copying material, means for forming a latent electrostatic image on said image-bearing member, developer means for applying a liquid developer comprising a liquid carrier having a toner dispersed therein onto said image-bearing member to form a toner image of the latent electrostatic image formed thereon, a corona charging means for thereafter removing excess liquid developer and simultaneously increasing the attaching force of the toner image to said image-bearing member, means for causing relative movement between said corona charging means and said image-bearing member, transfer means for transferring the toner image to copying material after removal of said excess liquid developer, and cleaning means for thereafter cleaning said image-bearing member for repeated use.

2. An electrophotographic copying device as in claim 1 wherein the surface of said image-bearing member is an insulating layer.

3. An electrophotographic copying device as in claim 1 wherein the image-bearing member comprises a base, a photoconductive layer overlying the base and an insulating layer overlying the photoconductive layer.

4. An electrophotographic copying device as in claim 1 wherein said image-bearing member is disposed about a cylindrical drum and said corona charging means is positioned within an angle not larger than 60° from a vertical line passing through the center of said cylindrical drum.

5. An electrophotographic copying device as in claim 1 wherein said corona charging means is disposed at a position wherein relative movement between said corona charging means and said image-bearing member, in response to said moving means, results in the corona charging being effected on the toner image within about 5 seconds after application of the liquid developer.

6. An electrophotographic copying device as set forth in claim 1, further comprising means for recovering the removed excess liquid developer.

7. An electrophotographic copying device as in claim 6 wherein said liquid developer recovery means includes aperture defining means on said corona charging means for recovering the removed excess liquid developer.

8. An electrophotographic copying device as in claim 1 wherein said developer means applies liquid developer having an electric resistance between $1 \times 10^{10}$ and $5 \times 10^{12}\Omega$cm.

9. An electrophotographic copying device comprising a cylindrical photoconductive drum, means for rotating said photoconductive drum, electrostatic image forming means for forming a latent electrostatic image on said photoconductive drum, developer means disposed adjacent said electrostatic image forming means for applying liquid developer comprising a carrier liquid having toner dispersed therein onto said photoconductive drum to form a toner image of a latent electrostatic image applied thereto, wherein excessive liquid developer collects at the lower portion of said photoconductive drum, a corona discharge means positioned downstream of said developer means in the direction of movement of said drum and within an angle not larger than 60° from a vertical line passing through the center of said photoconductive drum, for removing the excessive liquid developer and simultaneously increasing the attaching force of the toner image, means for recovering the removed excess liquid developer, transfer means for transferring the toner image to copying material after removal of the excessive liquid developer and cleaning means for thereafter cleaning said photoconductive drum for repeated use.

10. An electrophotographic copying device as in claim 9 wherein said developer means applies liquid developer having electric resistance between $1 \times 10^{10}$ and $5 \times 10^{12}\Omega$cm.

11. An electrophotographic copying device as in claim 9 wherein said corona charging means has aperture defining means for recovering the removed excess liquid developer.

12. An electrophotographic copying device as in claim 9 wherein said corona charging means is disposed at a position wherein relative movement between said corona charging means and said image-bearing member, in response to said moving means, results in the corona charging being effected on the toner image within about 5 seconds after application of the liquid developer.

* * * * *